United States Patent [19]

Cohen

[11] Patent Number: 4,747,410

[45] Date of Patent: May 31, 1988

[54] CUSHIONED ANTI-PRONATION INSERT

[76] Inventor: Lee S. Cohen, 4 Nichole Dr., Media, Pa. 19063

[21] Appl. No.: 96,239

[22] Filed: Sep. 3, 1987

Related U.S. Application Data

[63] Continuation of Ser. No. 801,836, Nov. 26, 1985, abandoned.

[51] Int. Cl.[4] ..... A61F 5/14; A43B 13/38

[52] U.S. Cl. ..... 128/581; 36/43

[58] Field of Search ..... 128/581, 583, 584; 36/43, 44

[56] References Cited

U.S. PATENT DOCUMENTS

| | | | |
|---|---|---|---|
| 51,986 | 1/1866 | Plumer . | |
| 1,055,768 | 3/1913 | Levee et al. . | |
| 1,137,092 | 4/1915 | Sharp | 36/43 X |
| 2,008,207 | 9/1935 | Greenberg . | |
| 2,034,463 | 3/1936 | Dvlinsky | 36/43 X |
| 2,119,807 | 6/1938 | Farley . | |
| 2,505,032 | 4/1950 | De Voos | 128/581 X |
| 3,309,797 | 3/1967 | Poitras . | |
| 4,084,333 | 4/1978 | Del Vecchio | 36/43 |
| 4,188,731 | 2/1980 | Keller . | |
| 4,268,980 | 5/1981 | Gudas | 36/43 |
| 4,346,525 | 8/1982 | Larson . | |
| 4,435,910 | 3/1984 | Marc . | |
| 4,510,700 | 4/1985 | Brown | 36/44 |
| 4,513,518 | 4/1985 | Jalbert . | |
| 4,517,981 | 5/1985 | Santipietro | 128/581 |

OTHER PUBLICATIONS

Disclosure of Lee S. Cohen for Capi TM A Shoe Insert; dated Mar. 1983.

"Forefoot Varus Biomechanical Compendium", *Podiatry Arts Lab, Inc.* (PAL).

*Primary Examiner*—Clifford D. Crowder

*Attorney, Agent, or Firm*—Hall, Myers & Rose

[57] ABSTRACT

An orthotic insert of unitary construction formed from a compressible, thermoset, closed-cell foam plastic, featuring an anterior varus wedge, a medial shelf corresponding to the first ray and a heel cup for stabilizing the calcaneus and underlying protective fat pad substantially in the neutral position, all contributing to minimizing excess foot pronation.

12 Claims, 2 Drawing Sheets

CUSHIONED ANTI-PRONATION INSERT

This is a continuation of application Ser. No. 801,836, filed Nov. 26, 1985, now abandoned.

TECHNICAL FIELD

This invention relates to an anti-pronation shoe insert and, more particularly, to a biomechanically designed cushioned insert composed of a closed-cell, foamed material.

BACKGROUND OF THE INVENTION

In the vast number of insole inserts designed and developed to mitigate podiatric problems, few embody physiological and kinesological aspects relating to locomotion and especially the problem of foot pronation. With few exceptions, the general conceptions relate to arch suport and shock absorption. Increased participation of the general population in athletic activity and primarily running has led to a notable increase in foot problems associated with pronation.

An abnormally pronated foot is one of the most common problems suffered by today's athletes, and in particular, by distance runners. While pronation may be caused by preexisting conditions, it may also be imposed upon a normal foot by overuse or injury during exercising. As is well known to those skilled in the art, a pronated foot disrupts the normal path of weight bearing and causes exaggerated internal rotation of the leg. This abnormal weight bearing causes functional changes in the foot, including, most commonly, a flattening of the longitudinal arch appearing on the plantar surface of the foot.

In order to better understand the concepts involved in locomotion, a description of the physiology and kinesiology of the foot is briefly reviewed. The foot is divisable into various regions. First, the lower surface of the foot is referred to as the plantar surface. The instep or interior side of the foot is termed medial while the outer side is the lateral. Concerning the bone structure and starting from the anterior (toes) to the posterior (heel), the several longitudinally extending bones are labeled, sequentially, the phalages, metatarsals, cuneiforms, naviculars, tali and finally the calcaneus (heel bone). The joints between these respective bones adopt the names of the two bones followed by articulation. For example, the joint between the metatarsal and phalanx of the big toe would be denominated the first metatarsal-phalanges articulation. Additional skeletal and muscle structures will be identified as applicable.

Turning now to a brief description of pronation, its general definition means "turning". As applied to the foot, it is a medical description of the turning of the foot relative to its medial longitudinal axis during locomotion. A certain amount of foot pronation is necessary. However, abnormal pronation often experienced during intense locomotion, principally during athletic activities where body weight on the heel, being multiplied by as many as four times, can result in a serious foot injury.

In the past, treatment of abnormally pronated foot conditions consisted of rest, physical treatment and rehabilitation. Physical treatments consisted of applying ice massages, cold whirpools, and muscle stimulation to help reduce inflammation and soreness which resulted from this condition. Further, administration of anti-inflammatory medications are used to mitigate swelling and soreness. Alternatively, some specialists have developed foam rubber arch supports covered with moleskin to help release some of the stress. Additionally, insertable arch supports are used which conform to the shape of the foot in a particular weight bearing position.

In keeping with the ancient bromide, "An ounce of prevention is worth a pound of cure", much effort has been dedicated to maximizing proper foot health. A veritable army of patents have issued for foot supports of various natures which contemplate and embody orthotic concepts. Some specifically consider abnormal pronation. Such devices have been around since the beginning of this century, as exemplified by U.S. Pat. No. 1,137,092 issued to C. Sharp in 1915. That patent includes a description of an insole constructed to resist "roll" of the foot. Greenberg in U.S. Pat. No. 2,008,207 addresses foot physiology in detail in the disclosure relating to an insole or shoe insert featuring a raised medial portion and a counter-balancing raised anterior lateral portion to prevent overstressing the lateral, fifth ray extending between the little toe and the heel.

More recent developments in this technical field are embodied in patent disclosures of Brown U.S. Pat. No. 4,510,700; Del Vecchio U.S. Pat. No. 4,084,333; Marsh U.S. Pat. No. 4,453,272; and Gudas U.S. Pat. No. 4,268,980. Referring briefly to each, Brown addresses a shoe sole insert formed of a closed-cell, foamed, plastic blank insert within a rigid cap. The cap is designed to provide controlled support for the heel to control pronation. Del Vecchio relates to a foot-supporting innersole having a plantar surface compatible configuration including a depression of parabolic contour for the heel and a corrugated anterior portion for receiving the toes. Marsh describes an orthotically-designed open sandal incorporating a structure which assists to prevent pronation while Gudas discloses a detorquing heel control insert of an elastomeric material having a Shore hardness of between 30–80 and an arcuate posterior ribbed portion to mitigate the effects of heel impact force on the foot.

Although the above-described devices and those others in this technical art field are not ineffective for their intended purposes, not one of the devices contemplates an insert which is designed to prevent abnormal pronation based strictly on the physics of locomotion and the biomechanical principles of pronation.

SUMMARY OF THE INVENTION

It is, therefore, an object of the instant invention to provide an insert which assists to prevent abnormal pronation.

It is another object of this invention to provide a foot support which contemplates the physics of locomotion and biomechanical principles of pronation to stabilize the foot during even intense athletic activity and provide comfort to the wearer while the foot is in the natural position.

Still another object of this invention is to provide a replaceable insole for insertion and use within a shoe which increases the efficiency and comfort of the shoe to the user.

These and other objects are satisfied by an orthotic device for contact with the plantar surface of a foot to minimize pronation, comprising a foot cushioning pad having an outline substantially conforming to the outline of a foot, said pad being composed of a closed-cell foam plastic material having a compression load deflection of 15–50 pounds per square inch; an anterior extension comprising a wedge rising from the line corresponding to the metatarsal phalangeal articulation to the cuneiform metatarsal articulation, a transverse varus wedge incorporated in said anterior extension of declining thickness from the medial to the lateral border of said pad, said wedge being positioned to underlie the metatarsal heads of the foot; a medial shelf incorporated longitudinally in said anterior extension, said shelf having a relatively greater thickness and compressibility than the next thicker portion of said anterior extension and being positioned to substantially underlie and support the first ray of the foot; a heel cup extending posteriorly of said anterior extension, said heel cup defining a wall and a recessed plantar support to accommodate the calcaneus in a manner to positionally stabilize the medial tuberosity and the heel fat pad; whereby the pad resists excess foot pronation by minimizing the horizontal displacement of the medial tuberosity and fat pad, directing the heel strike force substantially along the peroneus longus, assisting to effect a proper lever adapter sequence and resisting eversion of the subtalar joint.

The instant invention is formed from an absorptive fabric-covered, closed-cell, foamed material and combines six major biomechanical principles into one device to assist in prevention of common running injuries and to provide biomechanical stability by urging the pronated foot into the neutral position. The neutral position is that at which the foot acts most efficiently. The features incorporated into this invention and corresponding to those principles are: (1) an augmented depth heel cup; (2) a configuration contemplating direction of force vectors during locomotion; (3) variable compressibility corresponding to physical requirements; (4) sufficient medial longitudinal arch support; and (5) enhanced anterior metatarsal shock absorption coupled with enhanced transverse metatarsal cushioning.

The invention's features are based on the laboratory principles some of which are contemplated in the manufacture of custom orthotic device. However, unlike shoe modifications, these principles are embodied in an insert for direct contact with the foot where maximum benefits are achieved. Previously manufactured shoe inserts have not been able to adequately provide for minimizing abnormal pronation and achieve a neutral position for user comfort contemplated by the invention.

Referring first to the heel area, its purpose is to prevent excess pronation and maintain the foot in a more neutral position. Unlike certain posted orthodic devices, this invention does not rely on inverted heel wedge. Such devices require a prescription from a licensed doctor, and, accordingly, are not readily available. Rather, this invention seeks to minimize horizontal medial displacement of the heel plantar fat pad underlying the calcaneus by providing sufficient cross-sectional area in the heel cup to absorb the medially directed force thereby preventing fat pad displacement. This provision minimizes locomotion problems and foot injuries which may manifest themselves during running due to repeated and exaggerated pronation and, further, maximizes foot efficiency.

The instant invention further contemplates the presence of a heel cup with sloped walls having a depth of approximately one-half inch. This feature contributes significantly to controlling excess pronation and lateral instability. It provides a bed for the heel to sit in which assists to control rocking motion in the heel area and medial displacement of the sub-calcaneal fat pad. Such displacement and lateral instability results in general foot pain, tiredness and other over-use symptoms of the foot and leg muscles.

Due to biomechanical principles of locomotion, the invention contemplates an insole of varying thickness and density. The variation has two functions. The first is to allow the proper transference of the body's weight from the lateral heel and side of the foot, to across the middle part of the foot to the medial side of the foot along the first ray and through the great toe for final propulsion. This transference of the proper force vector allows for a normal gait during running cycle which minimizes excess pronation. As a result, muscle fatigue, strain and other pronation related problems are substantially avoided.

In brief, the thickness of the instant invention is greater in the posterior lateral one-third aspect of the device, and the medial anterior aspect under the first ray. The buildup in the anterior aspect constitutes a medial shelf composed of a compressible material permitting dynamic flexibility of the forefoot during locomotion. Furthermore, the augmented cushioned shelf allows for increased foot efficiency due to the spring-like effect of the foam material used in the construction of the insert.

Finally, moving to the additional cushioning material in the anterior extension, the invention features a varus wedge. The wedge comprises the forward portion of the anterior aspect. It is disposed transversely to the direction of elongation of the insole, declining at a 2°–3° angle from the medial to the lateral borders. In the context of biomechanics, the wedge raises the forefoot and opposes the abnormal geometry of an everted subtalar joint. Thus, in addition to helping accomodate for the transference and distribution of body weight in the foot, the varus wedge serves the second function of providing needed cushioning as well as rigidity in an area corresponding to the plantar fascia and the attachment of the plantar aponeurosis. Furthermore, the material comprising the wedge acts as a shock absorber and helps to prevent excess stress to the metatarsal heads where common problems occur such as stress fractures and metatarsalgia. Also due to the compressibility of the foamed plastic, it accommodates a wide range of variations of forefoot positions and the turning of the foot during pronation. Furthermore, the foam material has the capacity to essentially conform to an individual's foot due to body weight and heat, thus providing additional comfort. Moreover, cushioning in this area can also help prevent calluses and blisters caused by friction.

These foregoing features, objects and other aspects of the invention will become more apparent upon review of the following detailed description.

DETAILED DESCRIPTION OF THE INVENTION

Figure 1:
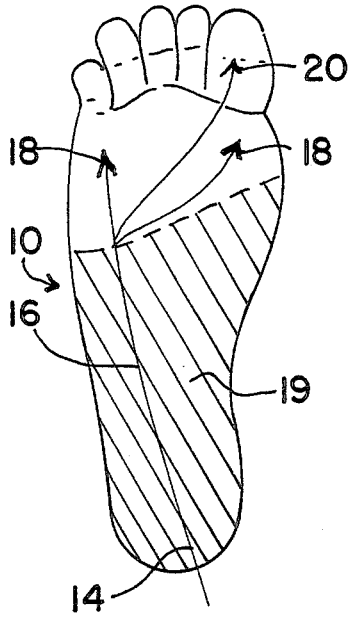
FIG. 1 is a diagrammatic view of a normal foot.
Figure 2:
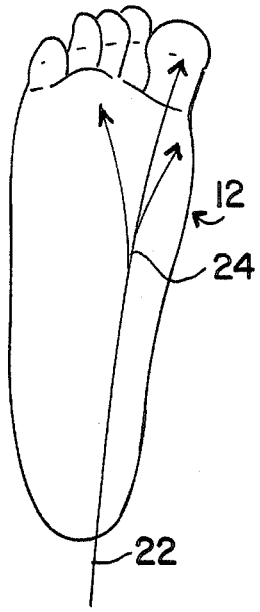
FIG. 2 is a diagrammatic view of a pronated foot.

Referring to FIGS. 1 and 2, there are shown the outlines of a profile of both a normal foot 10 and a pronated foot 12. As can be seen from the figures, and as is well known to those skilled in the art and the science of podiatry, a normal foot transmits the force impact observed by a runner through a path described and shown beginning at 14 in FIG. 1. The progression of the force transmission, beginning at point 14 as the heel strikes the underlying surfaces. The force continues up the indicated path in FIG. 1 to point 16 as the foot becomes a rigid lever where the articulated joints lock by means of contraction of the peroneus longus, the large foot muscle extending obliquely from the heel to the base of the first metatarsal head. When flexed normally, this muscle turns the first ray into a rigid lever which then causes the impact force to distribute, as illustrated, across the plantar surface at point 18. Finally, as the foot prepares to leave the ground, the impact force is transmitted through point 20, the great toe.

In comparison, the pronated foot, depicted in the bottom profile shown in FIG. 2, causes the impact force to be transmitted through the foot, as shown through line 22. In this case, the subtalar joint is everted and the bones of the first ray impact flat on the ground prior to the contraction of the peroneus longus muscle. In this condition, the peroneus longus effects a dorsiflexion of the first ray, completely opposite to the plantar flexion it should effect to lock the bones into the rigid lever position. Parenthetically, it is noted that the initial eversion of the subtalar joint is caused by a developmental problem. In the new-born infant, the bones of the foot are rolled into a ball. Gradual "derotation" of the bones takes place but incomplete derotation creates a residual eversion of the subtalar joint. The eversion of the subtalar joint prevents normal interaction between the musculature and skeletal components of the foot. Consequently, the progression of the mobile adapter-lever sequence is not realized. As a result, the subtalar joint becomes further everted (out of the neutral position) and the calcaneus extends laterally instead of being in a proper linear configuration. This, in turn, causes the foot to become off-balance which generates abnormal foot compensation and whereby the plantar facia and foot skeleton are crushed into the ground. In short, the force transmission line 22 is located closer to the medial longitudinal arch (first ray) of the foot 24, disrupting the normal path of weight bearing, causing exaggerated internal rotation of the leg, and inducing abnormal foot compensation. This functional change invariably leads to conditions such as plantar faciaitas or otherwise foot discomfort and or injury.

The pronated foot condition shown in FIG. 2 constitutes a viscious cycle where the eversion of the subtalar joint becomes increasingly more pronounced upon repeated impact. Accordingly, it is desirable to artificially modify the bottom of a foot by insertion of a surface between the running shoe insole and the bottom of the foot. The use of the present invention modifies the contact surface relative to a runner's foot such as to cause the force transmission through the foot, which suffers from pronation, to approximate the force transmission illustrated in the foot depicted in FIG. 1.

Area 19 in FIG. 1 illustrates the functionally significant area of the foot which the contour of the present invention modifies. This area has a plantar surface which is about 2 inches wide. Though the insert 30 is designed to contact the entire plantar surface area 19 comprises the central focus of the invention's biomechanical structure and function.

Figure 3:
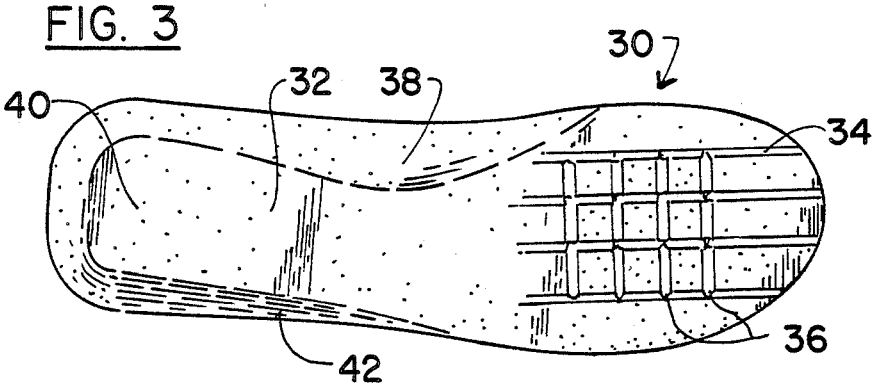
FIG. 3 is a bottom view of the invention.
Figure 4:
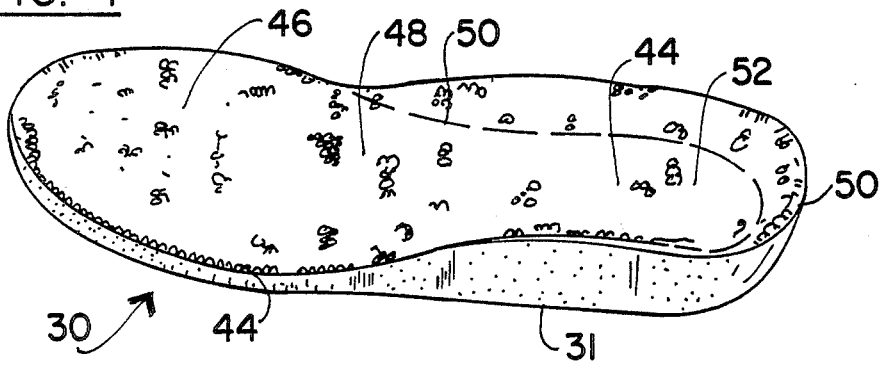
FIG. 4 is a perspective view of the invention.

Turning now specifically to the instant invention illustrated in FIGS. 3 and 4, insole insert 30, for the left foot, includes a substantially flat bottom surface 32 which lies on the upper surface of a shoe sole. The anterior portion of surface 32 features a checkerboard pattern of ridges 34 to enhance frictional engagement with and prevent slippage of insert 30 relative to the contiguous shoe sole. Additionally, holes 36 pass through the $\frac{1}{8}$ inch thickness of insert 30 at the intersection of ridges 34 to provide ventilation and to prevent air pockets from forming and causing displacement of insert 30 relative to the shoe sole.

Also evident are medial anterior arch support region 38, the bottom of heel cup 40 and peripherally disposed, outer sloping heel cup wall 42. The overall length of these sections for a man's size 10 shoe size is $6\frac{3}{4}$ inches.

Moving to FIG. 4, the plantar surface of insole insert 30 is illustrated. First, in order to maximize comfort, the surface is covered with soft fabric 44 such as terry cloth which is bonded to the underlying functional portion insert 31 with conventional adhesives. For example, a polypropylene yarn terry cloth material may be bonded with a hydrophobic, heat-activated adhesive such as Dow 777 available from Dow Chemical Company. Anterior portion 46 underlies the toes and extends posteriorly in a substantially flat plane to the parabola corresponding to the metatarsal-phalanges articulation (see FIG. 5 line 100). Described in greater detail below, anterior aspect 48 of insert 30 rises at an angle to line 110, proximate to the cuneiform-metatarsal articulation. Also, sloped peripheral wall 50 rises from the plantar surface starting approximately at line 100 and along the medial and lateral sides of insert 30 to a constant height of approximately $\frac{1}{2}$ inch at line 110 and around heel cup 52.

Figure 5:
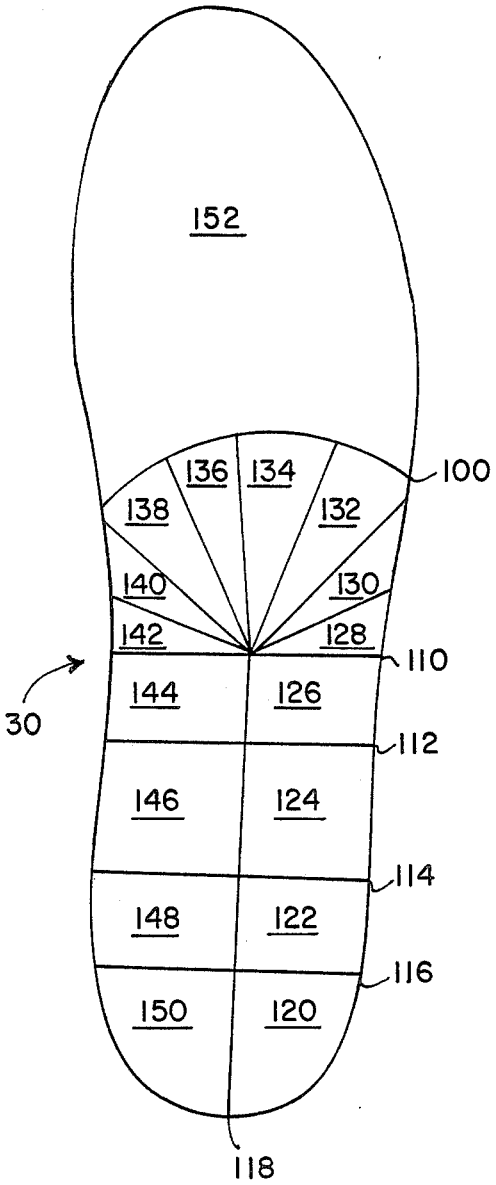
FIG. 5 is a sectioned representation of the invention.

Referring now to FIG. 5, representing a sectioned insert 30 for a man's size 10 shoe, dimensions are now given to better facilitate an understanding of the general structure of insert 30 contemplated by this invention. More particularly, the dimensions are given to illustrate the varying thickness of the insert to achieve biomechanically compatible structure and function necessary to prevent pronation.

Figure 6:
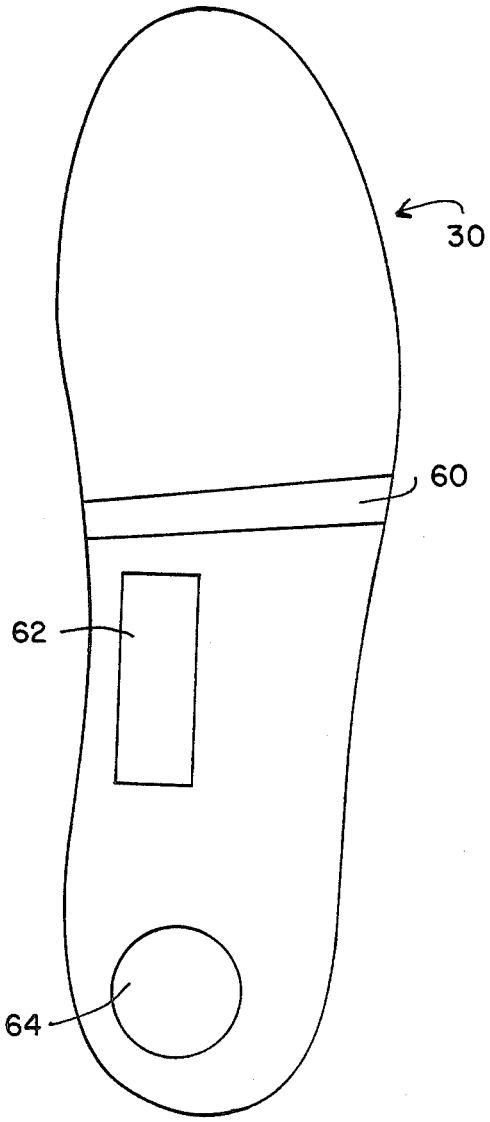
FIG. 6 is a diagrammatic representation of specific functional areas of the invention.

Perforated forefoot section 152 is of generally constant thickness of an $\frac{1}{8}$ inch and underlies the toes and the hallux ball of the foot. The anterior extension, a length approximately $2\frac{3}{8}$ inches, generally falling under the metatarsals, rises at an angle from a thickness of $\frac{1}{8}$ inch at line 100 to a thickness of $\frac{1}{4}$ inch along line 110. The anterior extension is divisable into the medial portion sections 136–142 incorporating medial shelf 62 (see FIG. 6) and the lateral portion 128–134. The forward portion of the anterior extension and underlying the metatarsal heads, just posterior to line 100, comprises varus wedge 60. (See FIG. 6). The apex of the wedge is formed on the lateral border where it has a thickness of approximately 2/16–5/32 inch increasing to 3/16–7/32 inch under the first ray. The wedge defines a constant angle of 2°–3°. Wedge 60 counteracts the tendency of an everted subtalar joint to turn the forefoot medially and into the ground.

Medial shelf 62 provides augmented cushioning of approximately 1/16 inch along the first ray between the metatarsal-cuneiform articulation and the metatarsal head and is approximately $1\frac{3}{4}$ inches in length. In contrast to known devices, medial shelf 62 is a prosthetic for enhancing shock absorbency of the first ray and overcoming the ineffective peroneus longus. This is achieved by assuring additional cushioning material and proper foot elevation.

In order to maximize the biomechanical function of insert 30, the remaining portions of the anterior extension have a lesser thickness but are fashioned to provide a smooth plantar surface. Accordingly, the thicknesses gradually change from wedge 60 and shelf 62. For example, the transverse thickness line 100 at the plantar-medial portion of the anterior extension ranges from $\frac{3}{8}$ inch at the periphery to 5/16 inch at bisector 118. The lateral portion is of a substantially constant thickness of 5/16 inch.

In addition to the provision of medial shelf and varus wedge, the entire anterior extension increases in thickness posteriorly to provide augmented opposition to reactive ground forces thereby minimizing the effects of an improperly functioning peroneus longus. Accordingly, stress on the first ray caused by eversion of the subtalar joint is decreased as the insert absorbs impact forces even in the absence of proper muscle function.

The next principal section of insert 30 underlies the navicular and cuneiform bones and comprises sections 124, 126, 144 and 146 and is approximately 2 inches in length. Here the plantar surface is substantially flat. The thickness along line 112 is approximately 5/16 inch except the medial plantar zone of section 146 which measures $\frac{1}{4}$ inch. Line 114, defining the anterior border of the subtalar support region measures 5/16 inch at the medial plantar edge decreasing to $\frac{1}{4}$ inch along bisector 118 and increasing again to 5/16 inch at the lateral plantar edge. Line 114 also forms the anterior boundary of heel cup 52 which measures $2\frac{3}{8}$ inches in length.

Moving to line 116 which underlies the calcaneus, the medial plantar border measures $\frac{3}{8}$ inch in thickness. The thickness decreases to $\frac{1}{4}$ inch toward bisector 118 to form a recess in which the heel is laterally stabilized. The insert thickness rises from the bisector to 5/16 inch and finally $\frac{3}{8}$ inch at the lateral plantar border.

Heel cup 52 is composed of sections 120, 122, 148 and 150. As noted previously, rising approximately $\frac{1}{2}$ inch above and peripherally disposed about cup 52 is sloped annular wall 50. Wall 50 is approximately 5/16 inch wide between the plantar surface and the outer edge of insert 30. The dimensional thickness of heel cup 52, as already stated, increases from bisector 118 to the lateral side of the plantar surface to provide added cushioning and positional stability for the heel. The bony heel, including the calcaneus, has an area of approximately 1.73 square inch. Projecting a slight distance below the calcaneus is the 0.8 inch wide medial tuberosity, the primary weight bearing portion of the heel which corresponds to zone 64 designated in FIG. 6. Underlying the entire calcaneus is a relatively fluid, fat pad which constitutes the foot's natural shock absorption mechanism.

Due to the displacement of the medial tuberosity from bisector 118, each impact force vector during normal walking gait, is resolvable into a vertical and horizontal component. The horizontal component comprises approximately 10% of the body weight. Thus, the horizontal component urges the fat pad to move horizontally, out of the neutral position, toward the medial axis, and the calcaneus, reactively to be directed laterally. During pronation such movement causes a greater degree of subtalar eversion. This problem is further exaggerated during running.

The above-mentioned displacement is significant as illustrated by the following example for a 200 pound man. The horizontal component equals approximately 20 pounds. Assuming that the medial tuberosity of the calcaneus constitutes a cross-section of a sphere and the radius of that sphere is approximately 0.74 inch, the horizontal cross-sectional area of the medial tuberosity is approximately 0.87 square inch. Consequently, the stress on the fat pad underlying the tuberosity caused by horizontal displacement is approximately 23 pounds per square inch. The heel cup depth of insert 30 is $\frac{5}{8}$ inch while its thickness is $\frac{1}{4}$ inch (for a total of $\frac{7}{8}$ inch). Multiplying this according to the formula $\frac{1}{2}r^2$, the cross-section equals approximately 1.2 square inches. Given this area, with a cushioning material having a 50% Compression Load Deflection value between 20–50 pounds per square inch (described in greater detail, infra), the horizontal component is completely equilibrated with no more than 50% deformation of the material. In view of the thickness of wall 50, the medial movement of the fat pad is minimized, being generally restricted to less than 5/32 inch. Consequently, the fat pad maintains the neutral position. Also, the laterally directed force on the calcaneus is accommodated. Thus, heel cup 52 positionally stabilizes the heel's skeletal structure and the fat pad which, in turn, effectuates maximal foot efficiency.

Moving now to the materials and productions methods employed in the construction of insert 30, it is necessary that certain physical characteristics be present in order to achieve the intended results. A closed-cell, foamed thermosettable plastic such as "Plastazote PO78" manufactured by BXL Plastics, Ltd. of Croyden Surry, England and available from United Foam Plastics of Georgetown, Massachusetts, possesses the desired qualities. "Plastazote PO78" has an original density of 5.5 pounds per cubic foot. Alternative materials found acceptable in the practice of this invention are "Plastazote" having an original density of 4.4 pounds per cubic foot, "Trocellen XJV 500" or laminated "Trocellen XJV 500". It is contemplated that these materials will be thermoset and, therefore, density will be increased. Where the plastic foam is thermoset to 50% of its original thickness, the density of the "Plastazote PO78" increases to 6.4 pounds per cubic foot, the "Trocellen XJV 500" to 6.2 pounds per cubic foot, and the laminated "Trocellen XJV 500" to 8 pounds per cubic foot. The "Plastazote PO78", employed in present production, at 50% thermoset increases in density to 6.1 pounds per cubic foot.

The "Plastazote PO78" employed in present production has a compression load deflection at 50% thermoset for a pad reduced from 0.5 to 0.25 inches according to the tests set forth in ASTMD-3574-81 of 19–27 pounds per square inch. The non-thermoset material (0.5 inch) is equal to 32 pounds per square inch. Of the alternative materials, the original "Plastazote" has a compression load deflection of 23–24 pounds per square inch while the "Trocellen XJV 500" exhibits a value of 24 pounds per square inch. The laminated "Trocellen" has a compression load deflection of 37 pounds per square inch. This compression load deflection is an important, characteristic, particularly in the context of stabilizing the calcaneus and minimizing the horizontal medially-directed shifting of the heel fat pad as described above.

To produce illustrated insert 30, contemplated by this invention, the following technique is employed. A sheet of ½ inch thick "Plastazote PO78", coated with the aforementioned adhesive and the upper surface being covered with the terry cloth padding, is placed in a convection oven ranging in temperature between 340° F. at the top and 400° F. at the bottom. The heating time necessary to achieve the thermo-forming transition temperature is 2–6 minutes at 284°–320° F. It should be noted that the polypropylene terry cloth cover will melt at a lower temperature than the "Plastazote" and, accordingly, the convection oven temperature above the sheet of "Plastazote" is lower than the temperature below the sheet.

Once the thermo-forming temperature is achieved, the sheet is removed from the oven and placed into a mold corresponding to the desired contour of insert 30. The mold is closed with a pressure ranging from 5–10 pounds per square inch and preferably 7 psi at a closing speed of between approximately 40–400 inches per minute. During molding the sheet is compressed resulting in a decrease in thickness. The thickness of the sheet corresponds to those dimensions recited above. Therefore, in general, the thickness is reduced by as much as 75% but generally about 50%. Once molding has been accomplished, the cooling time necessary before removing the inserts is approximately 2–6 minutes (similar to heating) which may be reduced by using a ventilated mold.

An alternative method to that set forth above, involves the known technique of heat molding. In this case, the "Plastazote" sheet or bun is placed directly into the mold which has been heated to approximately 320° F., whereupon a closing pressure of up to 40 pounds per square inch is employed. Once the molding has been completed, the finished insert, as above, is removed from the mold and any excess material may be trimmed therefrom.

Those of ordinary skill in this art can readily appreciate that the inserts for different shoe sizes will possess correspondingly different dimensions. The foregoing dimensions have been recited for only one size only for purposes of illustration.

While the invention has been described in connection with the illustrated embodiment, it will be understood that it is not intended to limit the invention to that embodiment. On the contrary, it is intended to cover all alternatives, modifications and equivalents as may be included within the spirit and scope of the invention as defined by the appended claims.

I claim:

1. An orthotic device for contact with the plantar surface of a foot to minimize pronation, comprising:

(a) a foot cushioning pad having an outline substantially conforming to the outline of a foot, said pad being composed of a foam plastic material having a compression load deflection of 15–50 pounds per square inch, (b) an anterior extension comprising a wedge rising from the line corresponding to the metatarsal phalangeal articulation to the cuneiform metatarsal articulation, a transverse varus wedge incorporated in said anterior extension declining in thickness from the medial to the lateral border of said pad, said wedge being positioned to underlie the metatarsal heads of the foot, (c) a medial shelf incorporated longitudinally in said anterior extension, said shelf having a relatively greater thickness and compressibility than the next thicker portion of said anterior extension and being positioned to substantially underlie and support the first ray of the foot, (d) a heel cup extending posteriorly of said anterior extension, said heel cup defining a wall and a recessed plantar support to accomodate the calcaneus in a manner to positionally stabilize the medial tuberosity and the heel fat pad, (e) whereby the pad resists excess foot pronation by minimizing the horizontal displacement of the medial tuberosity and fat pad, directing the heel strike force substantially along the peroneus longus, assisting to effect a proper lever adapter sequence and resisting eversion of the subtalar joints.

2. A device according to claim 1 wherein the pad is composed of a thermosetting plastic having a thermoset density of substantially 6 to 8 pounds per cubic foot and which is resilient thereby imparting springiness to the pad.

3. A device according to claim 1 wherein said varus wedge declines at an angle of substantially 2°–3° to urge the foot into the neutral position.

4. A device according to claim 2 wherein said varus wedge declines at an angle of substantially 2°–3° to urge the foot into the neutral position.

5. A device according to claim 4 wherein the medial wedge border is approximately 1.5 times as thick as the lateral border.

6. A device according to claim 1 wherein the medial shelf is greater in thickness by approximately 1/16 inch.

7. A device according to claim 3 wherein the medial shelf is greater in thickness by approximately 1/16 inch.

8. A device according to claim 1 where said heel cup features a sloped peripheral wall rising approximately ½ inch above the plantar surface.

9. A device according to claim 2 where said heel cup features a sloped peripheral wall rising approximately ½ inch above the plantar surface.

10. A device according to claim 1 further comprising a laminated soft, hydrophobic fabric material.

11. A device according to claim 10 where said fabric is a polypropylene yarn.

12. An anti-pronation orthodic shoe sole insert, comprising:

(a) a pad composed of resilient compressible foamed polymer shaped to conform to the outline of a foot substantially conforming to a foot's plantar surface and adapted to overlie substantially the entire upper surface of the shoe sole, (b) a transverse varus wedge having a greater thickness at the medial border than the lateral border said wedge being positioned to underlie the metatarsal heads, (c) a medial shelf for supporting the first ray and providing enhanced cushioning therefor, and (d) a heel cup for positionally stabilizing the medial tuberosity and heel fat pad, (e) where heel strike forces generated by locomotion are directed along vectors corresponding to a normal gait and counteracts eversion of the subtalar joints to minimize the effects of abnormal pronation.

* * * * *